United States Patent [19]

Miller, II

[11] Patent Number: 5,029,215

[45] Date of Patent: Jul. 2, 1991

[54] AUTOMATIC CALIBRATING APPARATUS AND METHOD FOR SECOND-ORDER GRADIENT MICROPHONE

[75] Inventor: Robert R. Miller, II, Convent Station, N.J.

[73] Assignee: AT&T Bell Laboratories, Murray Hill, N.J.

[21] Appl. No.: 459,164

[22] Filed: Dec. 29, 1989

[51] Int. Cl.[5] ..... H04R 29/00

[52] U.S. Cl. ..... 381/58; 381/170; 381/92; 367/13

[58] Field of Search ..... 381/92, 168, 58, 169, 381/170, 95, 26, 113, 114; 367/13, 135, 191, 21, 24, 65; 181/158, DIG. 1

[56] References Cited

U.S. PATENT DOCUMENTS

| | | | |
|---|---|---|---|
| 4,311,874 | 1/1982 | Wallace, Jr. | 381/92 |
| 4,536,887 | 8/1985 | Kaneda et al. | 381/92 |
| 4,742,548 | 5/1988 | Sessler et al. | 381/92 |
| 4,887,300 | 12/1989 | Erling | 381/168 |

*Primary Examiner*—Jin F. Ng

*Assistant Examiner*—Sylvia Chen

*Attorney, Agent, or Firm*—Samuel R. Williamson

[57] ABSTRACT

An automatic calibration system for a second-order gradient microphone is provided to ensure optimum sensitivity balance between a pair of first-order gradient microphones mounted in a housing and forming the second-order gradient microphone. Automatic calibration is achieved through use of a transducer also mounted in the housing and located equidistant acoustically between the two first-order gradient microphones. Under the control of a computer, the transducer is directed to generated sound pressure which is used to calibrate the gain of amplifiers respectively associated with each one of the first-order gradient microphones for obtaining maximum directional sensitivity for a second-order directional response pattern. Such a system not only allows the use of inexpensive, non-matched microphones, but also obviates the need for factory calibration. Since the system is configurable to optimize itself automatically prior to use, calibration may be maintained regardless of aging, environmental stresses and parts replacement.

22 Claims, 3 Drawing Sheets

AUTOMATIC CALIBRATING APPARATUS AND METHOD FOR SECOND-ORDER GRADIENT MICROPHONE

BACKGROUND OF THE INVENTION

1. Technical Field

This invention relates to directional microphones and more particularly, to an improved apparatus and method for calibrating these microphones.

2. Description of the Prior Art

Gradient microphones have been used for some time to selectively accept sound energy from a desired direction while excluding or attenuating sound energy from other directions. Recently, a class of gradient microphones has been developed which utilize two gradient (differential) microphones located along an axis to further enhance the directionality effects. Such microphone systems frequently employ an electronic delay at the output of one of two first-order gradient microphones whose output is then combined with the output of the second. One arrangement of such a system is described by G. M. Sessler, J. E. West and R. A. Kubli, *Unidirectional, Second-Order Gradient Microphone*, J. Acoust. Soc. Am., Volume 86, No. 6,2063–2067 (December 1989).

The attractiveness of second-order microphone systems is currently diminished by their relatively complicated mechanical and electrical design requirements. These microphone systems have a tendency toward performance degradation if the sensitivity of the two first-order microphones which comprise the compound second-order microphone system differs by more than a small amount. The degradation appears as a reduction of the microphone's directionality, accompanied by the appearance of undesirable side and rear lobes. There is a need, therefore, to obtain closely-matched first-order microphones and/or to carefully calibrate the associated microphone preamplifiers to achieve near-exact gain balance. Both of these approaches are costly. To obtain microphones matched to the degree of accuracy required (better than 0.5 dB), large numbers of microphones must be accurately calibrated and sorted into "bins", whose contents may then be sold as matched. Since this process involves the testing of many microphones to high accuracy, the use of matched microphones results in high system cost.

Alternatively, microphones less well-matched may be used with microphone preamplifiers whose gain can be accurately adjusted to compensate for the microphone mismatch. This process requires specialized equipment, an anechoic environment, and hand labor to perform the adjustment. The procedure involves use of a point sound source located in the far-field, in line with the axis of the microphone. With the rear null of the microphone pointed toward the source, the gain of the preamplifier connected to one of the first-order microphones is adjusted to minimize the output of the composite microphone.

Both of these alternatives still have limitations: As the microphones and amplifiers age, their sensitivity and gain may change unpredictably. Effects such as mechanical shock, temperature, humidity, and operating voltage may also contribute to loss of matching accuracy. This opens the possibility that even with exact factory calibration, microphone quality may degrade over time.

SUMMARY OF THE INVENTION

In accordance with the invention, an automatic calibration system for a second order gradient microphone is provided to ensure optimum sensitivity balance between a pair of two first-order gradient microphones which comprise the second-order gradient microphone. This unit is assembled such that the first-order gradient microphones are mounted in a housing along a common axis and separated by a critical distance "$d_1$". The housing includes passages capable of admitting sound pressure to both sides of each microphone's diaphragm and which extend to the surface of the housing forming open ports. During normal operation, the electrical output of one microphone is connected through a first preamplifier directly to a first one of two inputs of an amplifier configured as an analog subtracter. The output of of the second microphone is amplified by a second preamplifier, delayed electronically, then connected to the second input of the amplifier. The length of the electronic delay is frequently chosen to be equal to the time a sound wave requires to propagate in air through the distance $d_1$.

In accordance with the invention and in preferred embodiments, a sound-generating transducer is included in the microphone housing, situated between the two first-order microphones. The transducer is mounted in such a manner as to create a sound pressure within an adjacent volume area. This volume area extends away from the transducer and narrows into a passage or tube which terminates in a port situated equidistant between the two microphone ports nearest the center of the housing. The use of a single sound-generating transducer having a single volume and coupled to a single port enables application of controlled and equal pressure to the two adjacent microphone ports, dependent solely on the accuracy of the geometry of the housing.

Since the geometry of the housing may be accurately controlled during manufacturing, the transducer may be utilized to provide an arbitrarily well-balanced acoustic output to each first-order microphone diaphragm. Moreover, because the path loss from the source port to the microphone ports at the ends of the housing is significantly larger than the path loss to the microphone ports nearer the center of the housing, sound is applied effectively only to one side of each first-order microphone. Because the port which supplies the calibrated sound pressure is open to free space and in no way connects directly to any microphone port, minimum interference to normal microphone operation is achieved.

The system includes, in accordance with the invention and in preferred embodiments, a means by which one or both first-order microphone preamplifiers may be gain-adjusted under the control of a computer. The computer conducts an automated calibration procedure for adjusting the preamplifier gains to the optimum values which assure maximum directionality and minimum appearance of side and rear lobes. In initiating this calibration procedure, the computer begins by applying excitation to the sound-generating transducer. The resulting sound pressure generated by this transducer is supplied in equal proportion to the "rear" of the first microphone and the "front" of the second microphone. The frequency of the excitation signal may be fixed to maximize transducer efficiency, or if the transducer is efficient over a broad frequency range, the calibration procedure may be performed at several frequencies within the operating range of the microphone.

BRIEF DESCRIPTION OF THE DRAWING

This invention and its mode of operation will be more clearly understood from the following detailed description when read with the appended drawing in which.

Throughout the drawings, the same elements when shown in more than one figure are designated by the same reference numerals.

DETAILED DESCRIPTION

Figure 1:
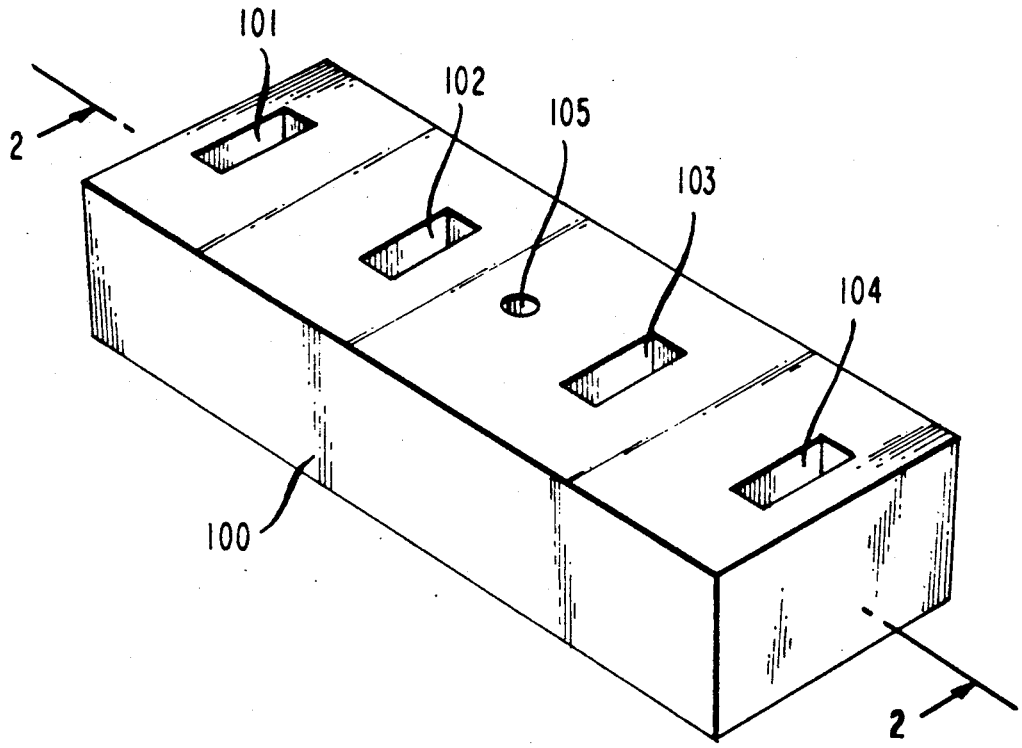
FIG. 1 shows a three dimensional view of a second-order gradient monolith assembly employing the invention.
Figure 2:
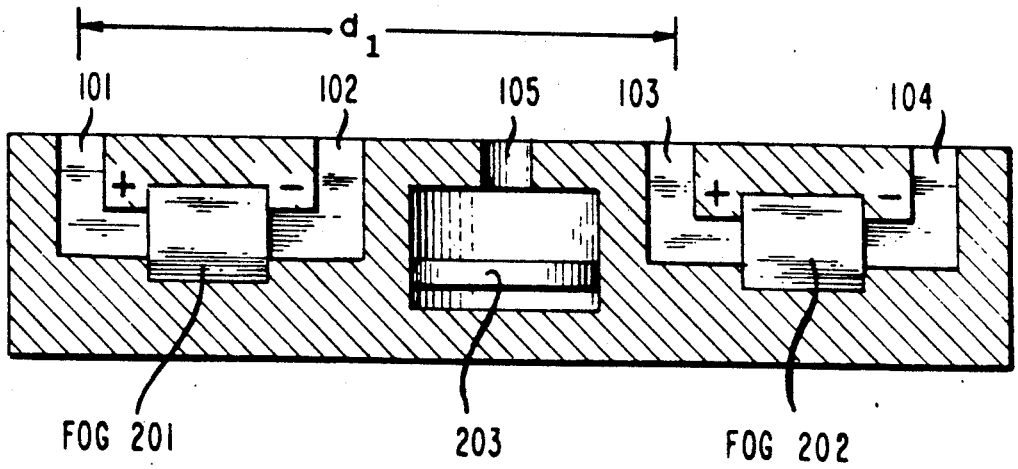
FIG. 2 is a cross-section view of the monolith assembly shown in FIG. 1 in accordance with the invention.

With reference to FIGS. 1 and 2, there is shown in FIG. 1 a three dimensional view of a second-order gradient monolith assembly 100 which illustratively comprises a molded rubber housing. Shown molded into the assembly are rectangular ports 101 through 104 and a centrally located circular port 105. The rectangular ports 101 and 102 admit sound pressure to a first-order gradient (FOG) microphone 201 and the rectangular ports 103 and 104 admit sound pressure to a first-order gradient microphone 202. The circular port 105 provides an outlet for sound pressure generated by a sound-generating transducer 203. This sound pressure is admitted to the rectangular ports 101 through 104 during a microphone calibration process described later herein.

A cross-section view of the monolith assembly 100 of FIG. 1 is shown in FIG. 2 for revealing the first-order gradient microphones 201 and 202, as well as the sound generating transducer 203 disposed in the monolith assembly 100. Each microphone samples sound pressure at two points along a propagating sound wave. The microphones 201 and 202 are electret transducers and are oriented along the central axis of the monolith assembly 100. They are polarized such that the negative terminal of microphone 201 is effectively connected to the positive terminal of microphone 202. The sound-generating transducer 203 is situated between the two first-order microphones 201 and 202. This transducer may be electromagnetic, electrostatic, or piezoelectric, and is mounted in such a way as to create a sound pressure within an adjacent volume area.

The sound pressure generated in this volume area is coupled to a passage which terminates in the port 105 situated equidistant between the two microphone ports 102 and 103 and nearest the center of the monolith assembly 100. The use of a single sound-generating transducer with a single volume, coupled to a single port, enables application of controlled and equal pressure to the two adjacent microphone ports 102 and 103, dependent solely on the accuracy of the geometry of the housing. Since this accuracy may be closely controlled during manufacturing, this simple sound source may be utilized to provide an arbitrarily well-balanced acoustic output to each first-order microphone diaphragm. Moreover, because the path loss from the source port 105 to the microphone ports 101 and 104 at the ends of the assembly is significantly larger than the path loss to the microphone ports 102 and 103 nearer the center of the monolith assembly 100, sound is applied effectively to only one side of each first-order microphone 201 and 202. Because the port 105 which supplies the calibrated sound pressure is open to free space and in no way connects directly to any microphone port, minimum interference to normal microphone operation is achieved.

Figure 3:
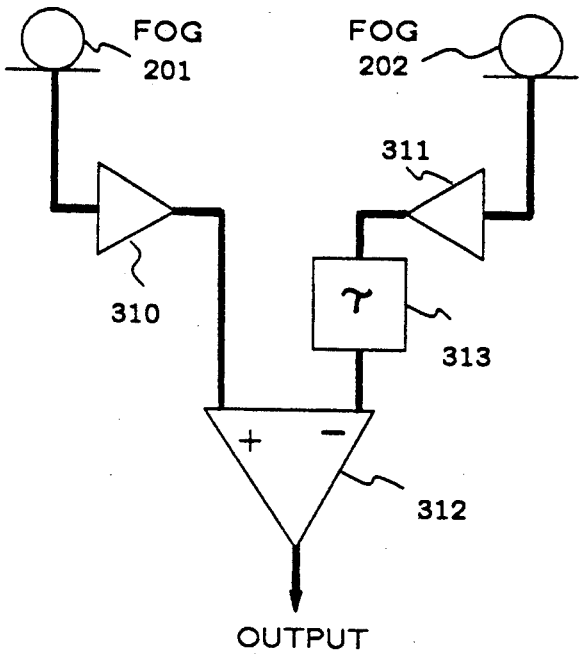
FIG. 3 is a simplified block diagram of which includes circuit elements and their interconnections used in normal operation of the second-order gradient microphone.

Referring next to FIG. 3, there is shown a block diagram which includes circuit elements and their interconnections used in the normal operation of the second-order gradient microphone. The electrical output of microphones 201 and 202 are respectively coupled to preamplifiers 310 and 311 for increasing the level of the associated microphone signals. These signals are coupled to and combined in a subtracter 312 which provides an output signal to and interfaces with any standard telecommunications device. The output of preamplifier 311 is first delayed by a time delay circuit 313 prior to its combination at the subtracter 312. The time delay contributed to the signal by the circuit of 313 is typically set to be equal to the time a sound wave requires to propagate through the distance $d_1$ shown in FIG. 2.

Figure 4:
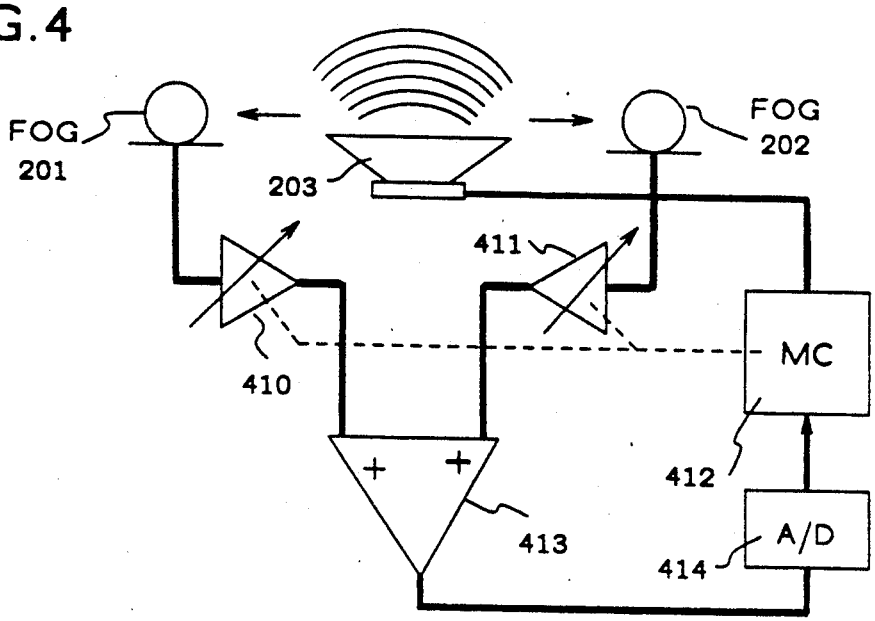
FIG. 4 is the block diagram of FIG. 3 modified to include the electrical circuit elements and their interconnections for accomplishing a calibration procedure in accordance with the invention.

With reference to FIG. 4, there is shown the block diagram of FIG. 3 somewhat modified to include electrical circuit elements and their interconnections for accomplishing the calibration procedure which assures maximum directionality and minimum appearance of side and rear lobes. The preamplifiers 410 and 411 are gain-adjustable to allow for automatic adjustment by a microcomputer (MC) or computer 412. And the outputs of the preamplifiers 410 and 411 are connected to a summing circuit 413 whose output is coupled to the computer 412 via an analog-to-digital converter 414.

In initiating the calibration procedure, the computer begins the procedure by applying an excitation signal to the sound-generating transducer 203. The frequency of the excitation may be fixed to maximize transducer efficiency, or if the transducer is efficient over a broad frequency range, then the excitation signal may be generated at several frequencies within the operating range of the microphone for better characterization of its response pattern. The sound pressure generated by the transducer 203 is supplied in equal proportions to the "rear" of microphone 201 via port 102 and the "front" of microphone 202 via port 103.

In distinguishing the operation of the circuit shown in FIG. 4 from the circuit shown in FIG. 3, the delay which is inserted in the electrical output path of microphone 202 for normal operation is removed (set to zero) during the calibration procedure, and the outputs of the microphones are summed in the summer 312 instead of being subtracted as is the case in normal operation. If a digital signal processor (DSP) is used as the computer 412, the delay and combination processes may be modified simply by programming; or alternatively, this change may be implemented using conventional field effect transistor (FET) switches.

Figure 5:
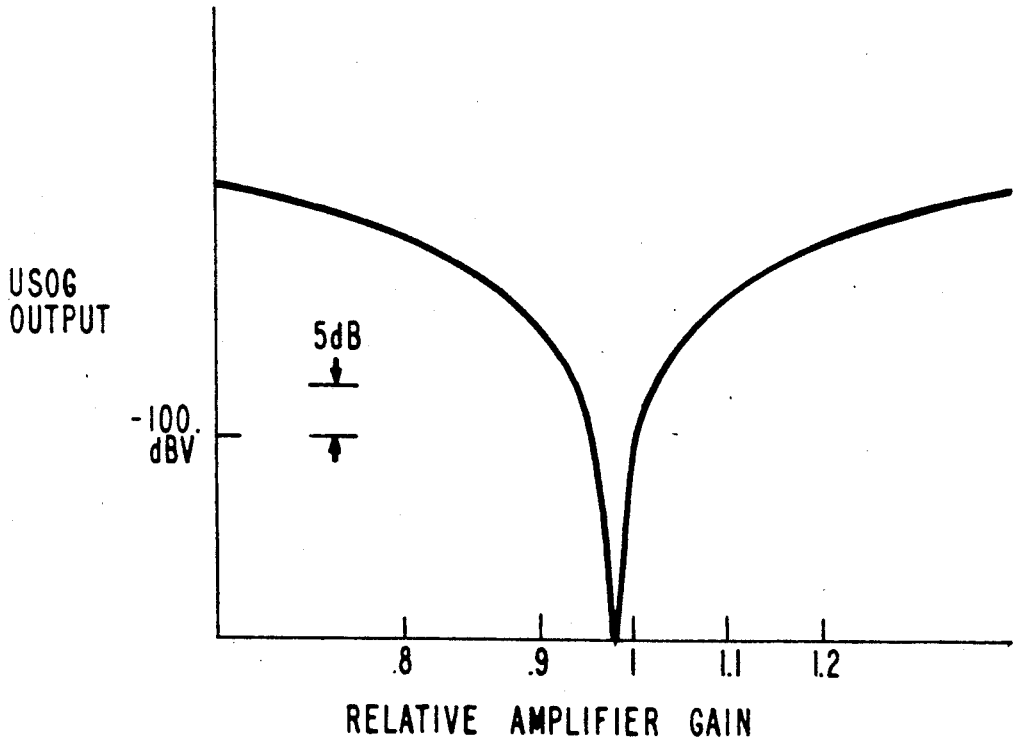
FIG. 5 depicts a graph of a representative nulling operation performed by the circuit of FIG. 4.

Because the phase of the sound wave propagating from the port 105 is the same at any point in time at each of the two nearby microphone ports 102 and 103, and the sound pressure is applied to the front of one microphone and the rear of the other, a complete or partial cancelation results as shown in FIG. 5. The completeness of the cancelation as reflected by the depth of the null in the electrical output is representative of the degree to which the microphones and their associated preamplifiers are matched. If both microphones 201 and 202 were of equal sensitivity and symmetric and both preamplifiers 410 and 411 were of equal gain, the sharp null would occur at a normalized gain of 1.0. In that these components are not identically matched, the microcomputer 412, by sampling the output of the summer 413 through use of the converter 414, adjusts the gain of either preamplifier 410 or 411 to achieve a maximum null output. The graph of FIG. 5 is the output of a unidirectional second-order gradient (USOG) microphone which shows that the computer 412 has adjusted the gain of one preamplifier to a value of 0.98 relative to the gain of the other preamplifier.

A stored program in computer 412 may use one of several known convergence techniques to achieve satisfactory null. The gain in the preamplifiers may be varied through using a digitally-controlled resistor as a gain-determining element in the preamplifier. Alternatively, use of a DSP allows the gain to be altered by modification of a programmed multiplication operation. Sharp nulls occur in normal (non-calibration) operation at frequencies only outside the effective bandwidth of the microphone. Since the calibration null is extremely sharp (small changes in gain produce large changes in composite second-order gradient microphone output), the resolution of the gain adjustment can be made with high precision.

Due to the wideband noise contributions of ambient sound energy, electrical noise generated by a FET amplifier inside each electret microphone, and limitations in the sound output of the generating transducer, it may be necessary in certain circuit arrangements to bandpass filter the summed microphone signals (at the excitation frequency) prior to sampling by the computer 412 to maintain sufficient signal-to-noise ratio for reliable nulling. Such narrow-band filtering reduces calibration inaccuracies in the event speech is present during the process.

Although the microphone calibration is normally conducted at the resonant frequency of the sound-generating transducer or acoustic source, as indicated earlier herein, the calibration procedure is also applicable and may be conducted at different frequencies to obtain the best compromise adjustment over a band of interest. Also, if the sound generator output level is accurately known, it is also possible to adjust the microphone output to a specific desired value by sampling as described herein and adjusting the gain of one microphone preamplifier to a desired level and then adjusting the other to ensure optimum sensitivity balance between the two microphones in the composite second-order system.

Various other modifications of this invention are contemplated and may obviously be resorted to by those skilled in the art without departing from the spirit and scope of the invention. By way of example, multiple first-order gradient microphones may be disposed in an assembly such as monolith assembly 100 along with a sound generating device such as transducer 203 which is then used to generate a sound source for calibration of all of the multiple microphones. It is understood, therefore, that within the scope of the appended claims, the invention may be practiced otherwise than as specifically described.

I claim:

1. An apparatus for calibrating a second-order gradient microphone including a pair of first-order gradient microphones disposed in a common housing along a common axis, the apparatus comprising:

a transducer disposed in the housing equidistant acoustically from the first and the second one of the pair of first-order gradient microphones, the transducer arranged for generating a sound pressure for coupling through a port associated with the transducer to the first-order gradient microphones via a pair of ports, each one of the ports in the pair being respectively associated with one of the first-order gradient microphones.

2. An apparatus for calibrating a second-order gradient microphone as in claim 1 further comprising a first and a second amplifying means respectively associated with the first and second first-order gradient microphones for amplifying the respective output signals therefrom, and a control means for controlling the gain of at least one of the amplifying means and for controlling the activation of the transducer.

3. An apparatus for calibrating a second-order gradient microphone as in claim 2 wherein the sound pressure generated by the transducer is received by the pair of first-order gradient microphones and a corresponding electrical signal is produced by each of the microphones, and in response to the difference in level of the electrical signals from each microphone, the control means adjusting the gain of at least one of the amplifying means to an optimum value with regard to the value of the other amplifying means for obtaining maximum directional sensitivity for a second order directional response pattern provided by the second order gradient microphone.

4. An apparatus for calibrating a second-order gradient microphone as in claim 3 wherein each one of the first-order gradient microphones has a first and a second sensing surface and the sensing surfaces of each microphone have a different one of two polarities, a first polarity being associated with the sensing surface of the first one in the pair of first-order gradient microphones for receiving the sound pressure through the first one of the pair of ports and a second polarity being associated with the sensing surface of the second one in the pair of first-order gradient microphones for receiving the sound pressure through the second one of the pair of ports.

5. An apparatus for calibrating a second-order gradient microphone as in claim 4 further comprising summing means arranged for receiving the output of the first and second amplifying means, the summing means providing an output signal reflective of the sum of the electrical signal level produced by each of the microphones responsive to the level of the sound pressure impinging upon the respective sensing surfaces of the microphones.

6. An apparatus for calibrating a second-order gradient microphone as in claim 5 wherein the output signal from the summing means is provided to the control means, the control means in response to the level of the output signal varying the gain of at least one of the amplifying means for nulling the effect of sensitivity differences in the first and second one of the pair of first-order gradient microphones for obtaining the desired second-order directional response pattern.

7. An apparatus for calibrating a second-order gradient microphone as in claim 6 wherein the first and the second first-order gradient microphones both comprise electret transducers.

8. An apparatus for calibrating a second-order gradient microphone as in claim 5 further including means for setting the output of the second-order gradient microphone at a predetermined level, the transducer being arranged for generating the sound pressure at a specific predetermined level and the output signal from the summing means being provided to the control means, the control means in response to the level of the output signal changing first the gain of the first one of the pair of amplifying means to a specified level and then the gain of the second one of the pair of amplifying means to a level that nulls the effect of sensitivity differences in the first and second one of the pair of first-order gradient microphones for obtaining the desired second-order directional response pattern.

9. An apparatus for calibrating a second-order gradient microphone including a plurality of first-order gradient microphones, each disposed in a common housing for receiving sound and for generating a respective output signal, the apparatus comprising:

a transducer disposed in the housing equidistant acoustically from the plurality of first-order gradient microphones, the transducer arranged for generating a sound pressure for coupling through a port associated with the transducer to the first-order gradient microphones via a plurality of ports, each one of the ports in the plurality being respectively associated with one of the first-order gradient microphones.

10. An apparatus for calibrating a second-order gradient microphone as in claim 9 further comprising a plurality of amplifying means respectively associated with the plurality of first-order gradient microphones for amplifying the respective output signals therefrom, and a control means for controlling the gain of at least one of the amplifying means and for controlling the activation of the transducer.

11. An apparatus for calibrating a second-order gradient microphone as in claim 10 wherein the sound pressure generated by the transducer is received by the plurality of first-order gradient microphones and a corresponding electrical signal is produced by each of the microphones, and in response to the difference in level of the electrical signals from each microphone, the control means adjusting the gain of at least one of the amplifying means to an optimum value with regard to the value of the other amplifying means for obtaining maximum directional sensitivity for a second order directional response pattern provided by the second order gradient microphone.

12. An apparatus for calibrating a second-order gradient microphone as in claim 11 further comprising summing means arranged for receiving the output of the plurality of amplifying means, the summing means providing an output signal reflective of the sum of the electrical signal level produced by each of the microphones responsive to the level of the sound pressure impinging upon sensing surfaces of the microphones.

13. An apparatus for calibrating a second-order gradient microphone as in claim 12 further including means for setting the output of the second-order gradient microphone at a predetermined level, the transducer being arranged for generating the sound pressure at a specific predetermined level and the output signal from the summing means being provided to the control means, the control means in response to the level of the output signal changing first the gain of at lesat a first one of the plurality of amplifying means to a specified level and then the gain of at least a second one of the plurality of amplifying means to a level that nulls the effect of sensitivity differences in this first and second one of the plurality of first-order gradient microphones for obtaining the desired second-order directional response pattern.

14. A method for calibrating a second-order gradient microphone including a pair of first-order gradient microphones disposed in a common housing along a common axis, the method comprising the steps of:

generating a sound pressure by a transducer disposed in the housing equidistant acoustically from the first and the second one of the pair of first-order gradient microphones, the sound pressure being coupled through a port associated with the transducer to the first-order gradient microphones; and receiving the sound pressure from the transducer via a pair of ports, each one of the ports in the pair being respectively associated with one of the first-order gradient microphones.

15. The method for calibrating a second-order gradient microphone as in claim 14 further including a first and a second amplifier respectively associated with the first and second first-order gradient microphones for amplifying the respective output signals therefrom, and further comprising the steps of controlling the gain of at least one of the amplifiers and controlling the activation of the transducer.

16. The method of calibrating a second-order gradient microphone as in claim 15 further comprising the steps of: generating in the microphones a corresponding electrical signal in response to the receipt of the sound pressure generated by the transducer; and adjusting the gain of at least one of the amplifying means to an optimum value with regard to the value of the other amplifying means in response to the difference in the level of electrical signal generated in each microphone, the adjusting step obtaining maximum directional sensitivity for a second order directional response pattern provided by the second order gradient microphone.

17. The method of calibrating a second-order gradient microphone as in claim 16 wherein each one of the first-order gradient microphones has a first and a second sensing surface and the sensing surfaces of each microphone have a different one of two polarities, a first polarity being associated with the sensing surface of the first one in the pair of first-order gradient microphones for receiving the sound pressure through the first one of the pair of ports and a second polarity being associated with the sensing surface of the second one in the pair of first-order gradient microphones for receiving the sound pressure through the second one of the pair of ports.

18. The method of calibrating a second-order gradient microphone as in claim 17 further comprising the steps of: receiving and summing the output of the first and second amplifier; and providing an output signal reflective of the sum of the electrical signal level produced by each of the microphones responsive to the level of the sound pressure impinging upon the respective sensing surfaces of the microphones.

19. The method of calibrating a second-order gradient microphone as in claim 18 further comprising the step of varying the gain of at least one of the amplifiers for nulling the effect of sensitivity differences in the first and second one of the pair of first-order gradient microphones for obtaining the desired second-order directional response pattern.

20. The method of calibrating a second-order gradient microphone as in claim 18 further comprising the steps of: generating the sound pressure at a specific predetermined level; and changing first the gain of the first one of the pair of amplifiers to a predetermined level and then the gain of the second one of the pair of amplifiers to a level that nulls the effect of sensitivity differences in the first and second one of the pair of first-order gradient microphones for obtaining the desired second-order directional response pattern.

21. A microphone apparatus comprising:

a housing;

first and second first-order gradient microphones disposed in said housing along a common axis; and a transducer disposed in said housing, said housing having a transducer port and first and second microphone ports formed therein in such a way that sound pressure generated by said transducer is coupled through said transducer port to said first and second microphones via said first and second microphone ports, respectively, said transducer port being equidistant between said microphone ports.

22. The apparatus of claim 21 further comprising means for generating a second-order gradient output signal which is a function of a combination, in selected proportion, of the outputs of said microphones and means for calibrating said apparatus by activating said transducer means and, in response to the resulting microphone outputs, selecting said proportion.

* * * * *